United States Patent [19]

Snow

[11] 4,208,052

[45] Jun. 17, 1980

[54] PUZZLE GAME HAVING MEMBERS ARRANGEABLE INTO PRESELECTED SEQUENCE

[76] Inventor: John D. Snow, 260, The Long Shoot, Nuneaton, Warwickshire, England

[21] Appl. No.: 9,980

[22] Filed: Feb. 6, 1979

[30] Foreign Application Priority Data

Feb. 10, 1978 [GB] United Kingdom ..... 5384/78

[51] Int. Cl.[2] ..... A63F 7/04

[52] U.S. Cl. ..... 273/113; 273/153 S

[58] Field of Search ..... 273/109, 113, 115, 153 R, 273/153 S

[56] References Cited

U.S. PATENT DOCUMENTS

| | | | |
|---|---|---|---|
| 509,362 | 11/1893 | Casler | 273/115 |
| 582,894 | 5/1897 | Berth | 273/113 |
| 706,658 | 8/1902 | Hock | 273/113 |
| 4,008,894 | 2/1977 | Renner | 273/153 S X |

*Primary Examiner*—Anton O. Oechsle

*Attorney, Agent, or Firm*—Wheeler, Morsell, House & Fuller

[57] ABSTRACT

Apparatus for playing a game or puzzle comprises a container which houses a plurality of balls of at least two identifiable kinds. The container defines a row of fixed compartments and a slide arranged in the container defines a movable row of compartments. The two rows of compartments are adjacent and parallel to each other, the slide having at least one more compartment than the container and each compartment being of a size such that it can accommodate only one member and having an open end adjacent the compartments of the other row to permit a member to enter or leave the compartment. The slide is arranged for oscillation between two extreme positions in each of which the open end of a respective end compartment of the slide is positioned to communicate with a track in the container interconnecting the two end compartments of the slide externally of the fixed compartments and the open ends of the remaining compartments of the slide are aligned with the open ends of the fixed compartments. An indicator indicates at least one pre-selected sequence in which the members are to be arranged in the compartments or track and the interior of at least part of the container is visible from outside the container to enable the sequence of members to be observed. Sequence changing means enable the sequence of the members to be changed from an initial sequence through intermediate sequences into a final sequence corresponding to said pre-selected sequence.

11 Claims, 11 Drawing Figures

PUZZLE GAME HAVING MEMBERS ARRANGEABLE INTO PRESELECTED SEQUENCE

BACKGROUND OF THE INVENTION

This invention relates to a game or puzzle, hereinafter called a game, in which a plurality of members of at least two identifiable kinds, there being at least one member of each kind, are housed in a container and are movable indirectly from initial positions in which the members are in an initial sequence with respect to each other, through intermediate positions into final positions in which the members are in a pre-selected sequence with respect to each other.

SUMMARY OF THE INVENTION

The object of the invention is to provide apparatus for playing the aforesaid game which comprises a container which, in use, houses a plurality of the aforesaid members of at least two identifiable kinds, there being at least one member of each kind, the container defining a row of fixed compartments arranged side-by-side; an oscillatable slide arranged in the container and defining a movable row of compartments arranged side-by-side, the two rows of compartments being adjacent and substantially parallel to each other, the number of the compartments in the slide being at least one more than the number of the fixed compartments, each compartment of each row being of a size such as to accommodate only one of the members, and each compartment in each row having an open end adjacent the compartments of the other row to permit entry to or exit from each compartment of a member, the slide being arranged for oscillation between two extreme positions in each of which the open end of a respective end compartment of the slide is positioned to communicate with a track in the container interconnecting the two end compartments of the slide externally of the fixed compartments and in which the open ends of the remaining compartments of the slide are in alignment with the open ends of the fixed compartments, indicator means to indicate at least one pre-selected sequence into which the members are to be arranged in one or other row of compartments or in the track, the interior of at least part of the container being visible from outside the container to enable the sequence of members to be observed, and means operative to permit the sequence of the members to be changed from an initial sequence through one or more intermediate sequences into a final sequence corresponding to the pre-selected sequence indicated by the indicator means, the members being movable between the fixed compartments and the compartments in the slide and through the track by tipping the container and by oscillation of the slide between its two extreme positions, and the sequence being changed by operation of the sequence-changing means.

Means are preferably provided in the said track to permit said members to pass out of the track in only one direction. Said means may comprise one or more flaps mounted in walls of the container defining said track.

The sequence changing means desirably comprise a door in the base of at least one of said fixed compartments leading to the track. The door is normally held in a closed position by spring means and it can be provided with an upstanding pin and the container provided with an arcuate recess in its wall through which said pin projects whereby said door can be opened by moving the upstanding pin along the recess against the action of the spring. The or each compartment provided with a door may additionally be provided with means for preventing a member passing through the door and entering the track from re-entering the compartment direct from the track. Said member-preventing means may comprise a flap pivotally mounted in walls defining said compartment.

According to a preferred embodiment of the invention, the container is provided with a lid made of transparent material.

The indicator means may comprise a rod rotatably mounted in said container and having indications marked thereon corresponding to means identifying the different kinds of members, said indications being arranged on said rod in a plurality of sequences.

The members preferably take the form of balls although other shapes may be employed for the members if desired.

BRIEF DESCRIPTION OF THE DRAWINGS

The invention will now be further described, by way of example, with reference to the drawings, in which.

DESCRIPTION OF PREFERRED EMBODIMENTS

Figure 1:
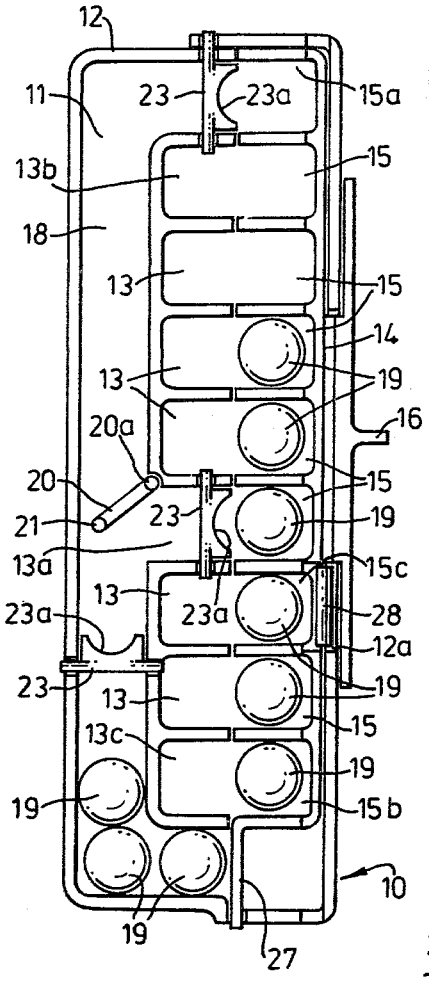
FIG. 1 is a plan view of one embodiment of an apparatus according to the invention showing the container tilted to the right and the slide in one end position but omitting the indicator means and container lid for the sake of clarity.

Referring to the drawings, the apparatus for playing a game or puzzle according to the invention comprises a substantially rectangular open-topped container 10 having a base 11 and an upstanding peripheral wall 12. A row of fixed compartments 13 arranged side-by-side upstand from the base 11 and may be either secured to or integral with the base. The row of compartments 13 is spaced from the peripheral wall 12 and extends longitudinally of the container 10. A slide 14 defining a movable row of compartments 15 arranged side-by-side is housed in the container 10 in the space between the row of fixed compartments 13 and a portion of the peripheral wall 12 which defines a longitudinal side of the container. The row of movable compartments 15 is substantially parallel with and adjacent the row of fixed compartments 13. The slide 14 is arranged to be oscillated between two extreme positions by an operating member 16 which is connected to the slide 14 through a slot 12*a* in the peripheral wall 12. Each compartment in each row has an open end adjacent the compartments of the other row. As shown in the drawings, there are eight fixed compartments 13 and nine movable compartments 15, but these numbers can, if desired, be increased or decreased provided the number of movable compartments 15 is always at least one more than the number of fixed compartments 13.

The compartments of each row have open tops which are covered by a transparent cover or lid 17 which also covers the open top of the container 10, the cover 17 being secured in any suitable manner to the peripheral wall 12. The remaining space between the row of fixed compartments 13 and the peripheral wall 12 defines a track 18. The container 10 houses a plurality of members which are freely-movable along the track 18. The track 18 is of such a width as to permit movement of the members in single file. The members are in the form of balls 19 of at least two identifiable kinds, there being at least one ball of each kind. In order that the balls 19 can be identified one or more of the balls may be of one colour and the remaining balls may be of another colour, or one or more of the remaining balls may be of different colours. The number of balls 19, in the embodiment shown, is equal to the number of movable compartments 15, so that therefore nine balls 19 are provided. However, the number of balls 19 could be either more or less than the number of movable compartments 15. Each of the compartments 13 and 15 are of such a size as to receive one only of the balls 19.

One of the fixed compartments 13, e.g. compartment 13*a*, is provided with a hinged door 20 which is openable to connect the compartment 13*a* directly with the track 18. Therefore when one of the balls 19 is contained in the compartment 13*a*, the ball can, by opening the door 20, be released directly into the track 18. The door 20 is hinged between the base 11 and the cover 17 by providing it with circular lugs 20*a* at each end which are inserted in bores in the base and cover (only the bore 17*a* in the cover 17 is shown in the drawing). The door is normally biased into a closed position by a spring 20*b* (FIG. 4) and is openable from the closed position by an operating pin 21 which is secured to the door 20 and extends through an arcuate slot 22 in the cover 17. The door 20 defines the aforesaid sequence-changing means. It should be understood that more than one of the fixed compartments 13 may be provided with a door similar to the door 20.

Two non-return flaps 23 are provided in the track 18 to permit free passage of the balls 19 along the track in one direction, but preventing passage of the balls 19 in the other direction. The flaps 23 are pivotally located in grooves in the upper edge of the peripheral wall 12 and the adjacent wall of the fixed compartments 13 and are held in place by the cover or lid 17. A flap 23 is also provided in the compartment 13*a* and is pivotally located in grooves in the upper edge of the compartment walls as shown in FIG. 4.

Figure 4:
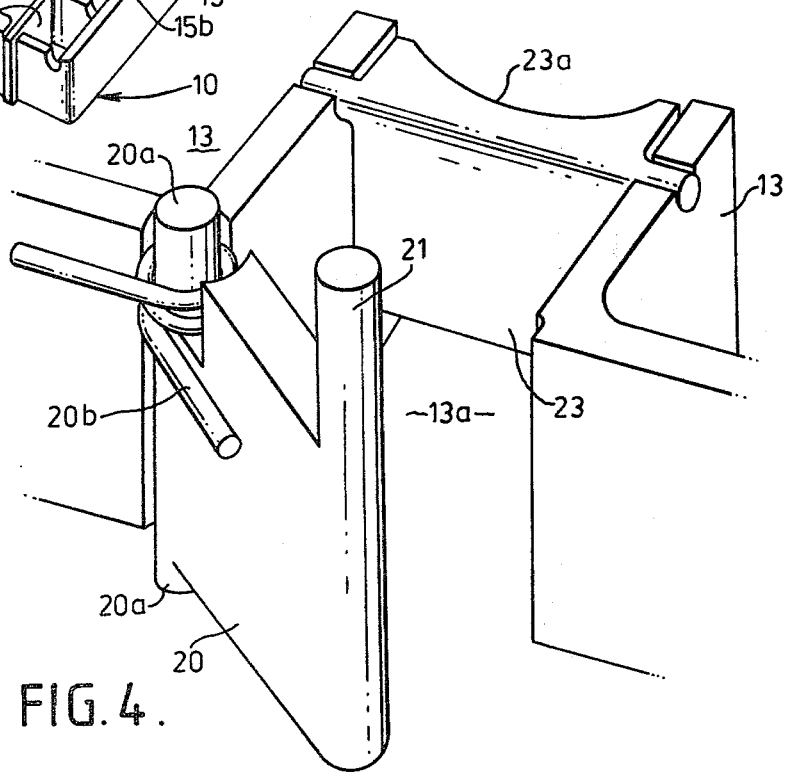
FIG. 4 is a perspective view, to an enlarged scale, of one embodiment of a sequence changing means forming part of the apparatus according to the invention.
Figure 5:
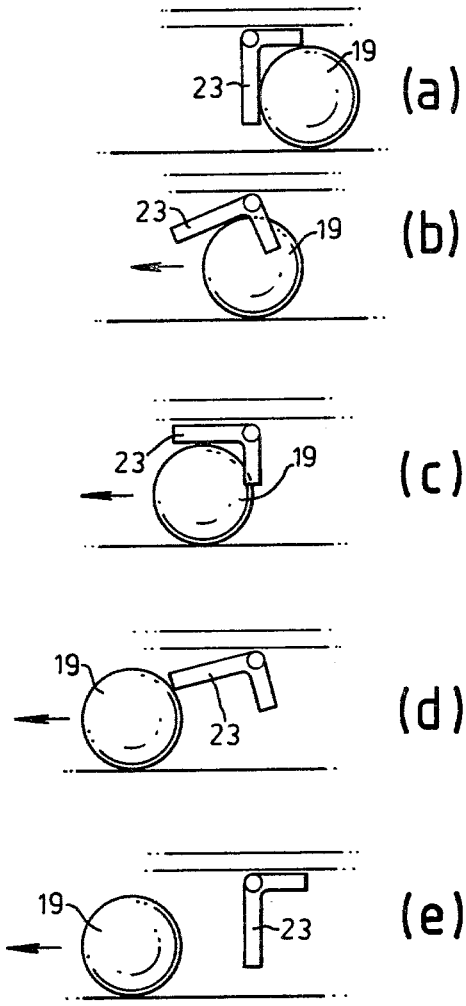
FIGS. 5(*a*)–5(*e*) show the sequence of operations of a ball passing through a flap.

As shown in FIG. 4, each flap has a longer limb and a shorter limb extending substantially at right angles to each other with the pivoting axis coinciding substantially with the junction between said limbs. The flaps 23 normally hang with their longer limbs hanging vertically downward as shown in FIG. 5*a* because the weight of the longer limb is greater than that of the shorter limb. The longer limb of each flap can be swung clear by the passage of a ball 19 beneath it as shown in FIG. 5*b* and the shorter limb of each flap is provided with an arcuate recess 23*a* which permits free passage of a ball up to about 45° of pivoting of the flap. As the ball passes through the flap, the longer limb is moved to a substantially horizontal position as shown in FIG. 5(*c*). Once the ball has passed on clear of the longer flap, as shown in FIG. 5(*d*), the latter is free to return to its normal vertical position, as shown in FIG. 5(*e*), and pivoting of this flap in the reverse direction is prevented by virtue of engagement of the associated shorter flap with the cover 17 which thus restricts pivoting of the flaps to a maximum angle of about 90°. Thus, the ball 19 cannot pass through the flap in the reverse direction.

Figure 6:
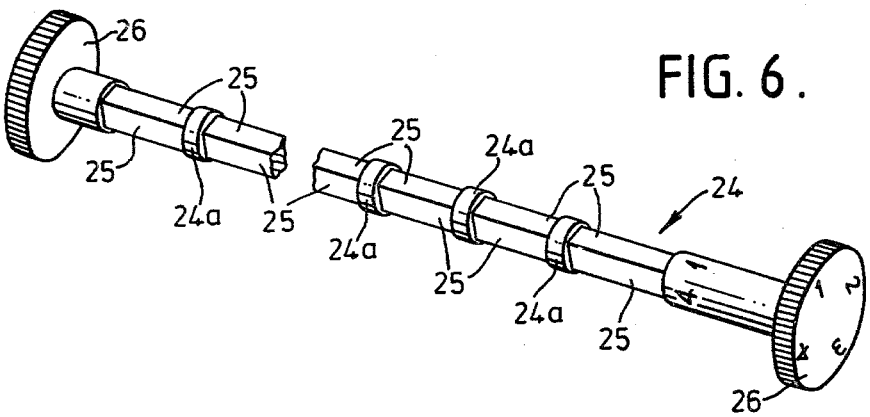
FIG. 6 is a perspective view, to an enlarged scale, of one embodiment of an indicator forming part of the apparatus according to the invention.

An indicator in the form of an axially rotatable rod 24 is supported in the container adjacent the slide 14 and extends parallel with the slide. As shown in FIG. 6, the rod 24 is provided with four circumferentially-spaced axial rows of coloured portions 25 corresponding in number and colour to the number and colour of the balls 19. Each row of coloured portions 25 has the coloured portions 25 arranged in a different sequence so that by rotating the rod 24, by means of one of a pair of thumb wheels 26 secured to the ends of the rod, any one of the four different rows of coloured portions 25 can be made visible through the cover 17. It will be appreciated that the rod 24 may be provided with more or less than four circumferentially-spaced axial rows of coloured portions 25. The axial length of the portions 25 corresponds to the width of the compartments 13 and 15 and the portions 25 are separated from each other in the axial direction by circular portions 24*a* of the rod 24.

Figure 2:
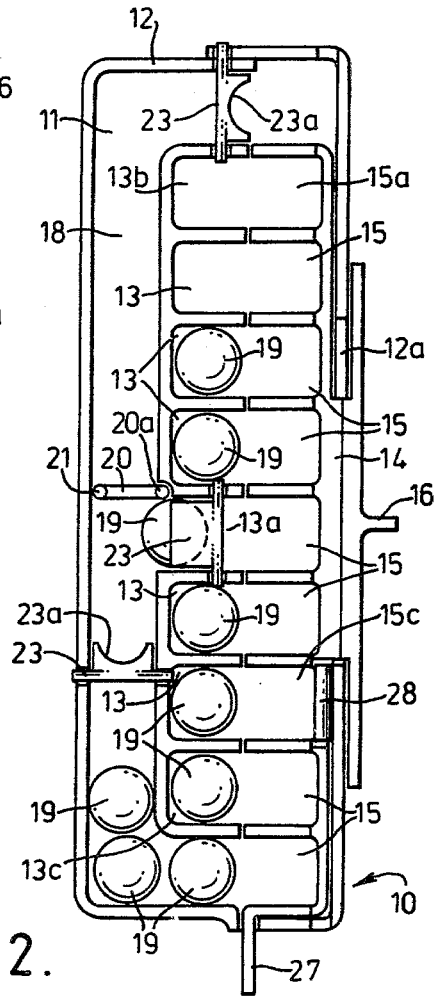
FIG. 2 is a plan view of the apparatus shown in FIG. 1 showing the container tilted to the left and the slide in its other end position but with the indicator means and container lid again omitted for the sake of clarity.
Figure 3:
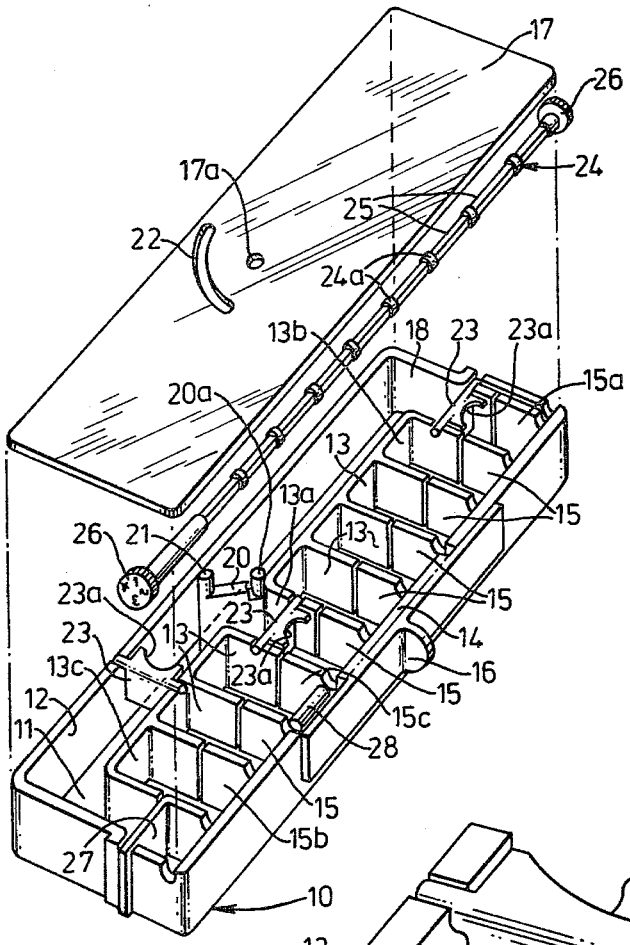
FIG. 3 is an exploded perspective view of the apparatus shown in FIGS. 1 and 2 showing the indicator means and container lid but omitting the ball-like members for the sake of clarity.

When the slide 14 is moved into one of its extreme positions, for example, the position shown in FIG. 1, one end compartment 15*a* of the movable compartments 15 is positioned in the track 18 outwardly of the adjacent end compartment 13*b* of the fixed compartments 13. In FIG. 2, the slide 14 is shown in its other extreme position in which the other end compartment 15*b* of the compartments 15 is positioned in the track 18 outwardly of the adjacent end compartment 13*c* of the compartments 13. In either extreme position of the slide 14, the open ends of the remaining movable compartments 15 are in alignment with the open ends of the fixed compartments 13. The slide 14 is provided with an extension 27 adjacent the compartment 15*b*, the extension 27 extending across the track 18 and through a slot in an adjacent part of the peripheral wall 12. The extension 27 prevents a ball 19 in the track 18, when the slide 14 is in the position shown in FIG. 1, becoming positioned between the lower compartment 15*b* and the peripheral wall 12, thus preventing movement of the slide 14 into the position shown in FIG. 2.

The game is suitable for any number of players, each playing in a selected predetermined order or it can be played with each player, using individual and identical apparatus, competing to achieve completion of an agreed sequence or sequences before the other player or players have completed theirs. Each player plays the game by holding the container 10 so that the cover 17 is uppermost and the operating member 6 is at the right-hand side. Also the container 10 should be held tipped to the right. Then one of the rows of coloured portions 25 is selected by rotating the rod 24. The object of the game is to position one ball 19 in each of the compartments 15 in a sequence corresponding to the sequence of the selected row of coloured portions 25. Assuming that each compartment 15 contains a ball 19, the balls 19 will be in an initial sequence, which sequence does not correspond to the sequence of the coloured portions 25 of the selected row. Each player then compares the colour sequences of the balls 19 and the selected row of portions 25 to determine whether the ball in the compartment 15, which is in alignment with the compartment 13*a*, or the ball in the end compartment 15*a* should be released first into the track 18. It is assumed that the slide 14 is in the position shown in FIG. 2. If the ball in the compartment 15 which is in alignment with the compartment 13*a* is to be released into the track 18 first, the door 20 is opened and the container is tipped to the left so that the ball moves from the compartment 15 to the compartment 13*a* and into the track 18 and the door 20 is allowed to close. The ball is moved along the track 18 to the end of the slide 14 which is provided with the extension 27, by tipping the container 10 in the appropriate direction. In tipping the container 10 to the left the balls 19 in the remaining compartments 15 will be transferred to the aligned compartments 13. The container is then tipped to the right so that the balls 19 will be transferred back into the compartment 15, and the slide is moved to the position shown in FIG. 1. Again either the ball in the end compartment 15*a* or the ball in the compartment 15 which is in alignment with the compartment 13*a* can be released first into the track 18. If, in this instance, the ball in the compartment 15*a* is to be released into the track 18 first, the container 10 is tipped both to the left to move the ball 19 from the end compartment 15*a* into the track, and in a direction to allow the ball to travel along the track to the end of the slide 14 provided with the extension 27. This tipping movement of the container to the left will result in each of the balls 19 being transferred from the compartments 15 into the aligned compartments 13. However, the compartments 13 into which each of the balls 19 is transferred will not be the same compartment into which each ball 19 entered when the container was previously tipped to the left, but the next adjacent compartment 13 in the direction of movement of the slide from the position shown in FIG. 2 to the position shown in FIG. 1. Whilst maintaining the container 10 in the tipped position to the left, the slide 14 is returned to the position shown in FIG. 2. Tipping of the container 10 to the right will transfer the balls 19 from the compartment 13 into the aligned compartments 15 and will also position the first ball in the track 18 in the end compartment 15*b* so that the slide 14 can be moved to the position shown in FIG. 1. It will be appreciated that by appropriately tipping the container 10 and by oscillating the slide 14 between its two extreme positions, the balls 19 will be transferred in turn into and from the track 18 and successively into each of the compartments 13 and 15. In addition, the initial sequence of the balls 19 can be changed by opening the door 20, to release a ball which is contained in the compartment 13*a* into the track. In this way, the initial sequence of the balls 19 can be changed through intermediate sequences into a final sequence corresponding to the sequence of the selected row of coloured portions 25.

In the above described example, it is intended that the movement of the balls should follow a counter-clockwise direction although the arrangement could, if desired, be constructed asymmetrically opposite, the direction of movement then being clockwise. In either case, it would be possible to reverse the intended direction of movement by transferring the balls into the slide by tilting the container to the right, moving the slide rearwards (downwards with respect to FIGS. 1 and 2), and then transferring the balls to the fixed compartments by tilting the container to the left. This possibility would be contrary to the principle of the game which requires that once a calculated movement has been made, errors of judgement cannot be corrected without the penalty of further excessive movements of the slide and door.

Therefore, in order to ensure that once the slide has been moved forward while tilted to the right, it cannot be moved back without first tilting the container to the left to transfer the balls to the fixed compartments, means are preferably provided to restrain the slide from being reversed while still tilted to the right. Such restraining means may take the form of a roller 28 located in a recess in the slide in the bottom wall of the compartment 15*c* which is aligned with the slot 12*a* in the side wall 12 of the container when the slide 14 is in the end position shown in FIG. 1 and which is covered by the side wall 12 when the slide is in the end position shown in FIG. 2. Thus, when the slide is moved forward from the position shown in FIG. 2 to the position shown in FIG. 1 with the container tilted to the right, the roller 28 rolls into the slot 12*a* and prevents reverse movement of the slide until the container is tilted to the left when the roller 28 rolls clear of its obstructing position. The tilting to the left, however, transfers the balls to the fixed compartments 13 and therefore errors can be corrected only by extra operations of the slide and door as above described.

The game may be played by each player being timed by a stop watch to determine the length of time taken in arranging the balls 19 into a sequence corresponding to the sequence of the selected row of coloured portions 25. The winner of the game is the player who arranges the balls in the correct sequence in the shortest time. Alternatively the length of time taken for each player to arrange the balls 19 into sequences corresponding to the sequences of each of the rows of coloured portions 25 is taken. A further alternative is that the number of complete oscillations of the slide 14 and/or opening movements of the door 20 in which to obtain one or more pre-selected sequences of the balls 19 are counted. In this case the winner of the game is the player making the least number of oscillations and/or opening movements of the door 20.

Instead of the balls 19 and the portions 25 being coloured, numbers or symbols may alternatively be used.

Instead of providing balls 19, members of another shape, e.g. cubes of a size to enable them to move freely along the track 18 and into and out of each of the compartments 13 and 15 may be used. Alternatively each of the balls 19 may have a substantially flat cap secured to the upper surface of each ball. Each cap may instead rest on the respective ball 19 in which case each cap may be provided on its underside with a spherical seating for the associated ball.

A catch may be provided to lock the slide 14 in a position intermediate its end positions, so that when each compartment 15 contains a ball 19, the slide can be retained in the intermediate position to prevent the balls 19 leaving the compartments 15 when the container is being carried.

Instead of the two rows of compartments 13 and 15 being linear, as illustrated, they may be arcuate and in that case the container may be correspondingly curved.

The rod 24 may be replaced by pins of a number corresponding to the number of members and each having a colour, number or symbol thereon to agree with that of the members. In this case each pin may be engageable in a hole in the container adjacent each compartment 15, so that random sequences can be obtained by interchanging the positions of the pins.

Instead of the or each door 20, other sequence-changing means may be provided, e.g. a compartment may be provided on the exterior of the peripheral wall 12 and in communication with the track 18 through an opening in the peripheral wall 12.

The container is preferably of such a size that it can fit conveniently into a pocket. However, the container may be made smaller or larger if desired.

I claim:

1. Apparatus for playing a game or puzzle, said apparatus comprising a container defining a row of fixed compartments arranged side-by-side and a track providing interconnecting means between the ends of said row of fixed compartments; an oscillatable slide arranged in the container and defining a movable row of compartments arranged side-by-side, the two rows of compartments being located adjacent and substantially parallel to each other; a plurality of members of at least two identifiable kinds, there being at least one member of each kind; the number of compartments in said slide being at least one more than the number of said fixed compartments, each compartment of each row being of a size such as to accommodate only one of said members and each compartment in each row having an open end adjacent the compartments of the other row to permit entry to or exit from each compartment of a member, the slide being arranged for oscillation between two extreme positions in each of which the open end of a respective end compartment of the slide is positioned to communicate with said track in the container and the open ends of the remaining compartments of the slide are in alignment with the open ends of the fixed compartments; indicator means to indicate at least one pre-selected sequence into which the members are to be arranged in one or other row of compartments or in the track, the interior of at least part of the container being visible from outside the container to enable the sequence of members to be observed; and means operative to permit the sequence of the members to be changed from an initial sequence through one or more intermediate sequences into a final sequence corresponding to the pre-selected sequence indicated by the indicator means, the members being movable between the fixed compartments and the compartments in the slide and through the track by tilting of the container and by oscillation of the slide between its two extreme positions and the sequence being changed by operation of the sequence-changing means.

2. Apparatus as claimed in claim 1, in which means are provided in said track to permit said members to pass out of the track in only one direction.

3. Apparatus as claimed in claim 2, in which said means comprise at least one flap pivotally mounted in walls of the container defining said track.

4. Apparatus as claimed in claim 1, in which said sequence changing means comprise a door in the base of at least one of said fixed compartments leading to said track.

5. Apparatus as claimed in claim 4, in which said door is normally held in a closed position by spring means.

6. Apparatus as claimed in claim 4, in which said door is provided with an upstanding pin and in which said container is provided with an arcuate recess in its wall through which said pin projects whereby said door can be opened by moving the upstanding pin along the recess.

7. Apparatus as claimed in claim 4, in which the or each compartment provided with a door is additionally provided with means for preventing a member passing through the door and entering the track from re-entering the compartment direct from the track.

8. Apparatus as claimed in claim 7, in which said member preventing means comprise a flap pivotally mounted in walls defining said compartment.

9. Apparatus as claimed in claim 1, in which said container is provided with a lid made of transparent material.

10. Apparatus as claimed in claim 1, in which said indicator means comprise a rod rotatably mounted in said container and having indications marked thereon corresponding to means identifying the different kinds of members, said indications being arranged on said rod in a plurality of sequences.

11. Apparatus as claimed in claim 1, in which said members take the form of balls.

* * * * *